US010876419B2

(12) United States Patent
Kim

(10) Patent No.: US 10,876,419 B2
(45) Date of Patent: Dec. 29, 2020

(54) CONJUNCTION ASSEMBLY AND GAS TURBINE COMPRISING THE SAME

(71) Applicant: DOOSAN HEAVY INDUSTRIES & CONSTRUCTION CO., LTD., Changwon-si (KR)

(72) Inventor: Dong Hwa Kim, Seoul (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 190 days.

(21) Appl. No.: 16/032,039

(22) Filed: Jul. 10, 2018

(65) Prior Publication Data

US 2019/0101013 A1 Apr. 4, 2019

(30) Foreign Application Priority Data

Sep. 29, 2017 (KR) ..... 10-2017-0127459

(51) Int. Cl.
*F01D 11/00* (2006.01)
*F01D 9/02* (2006.01)
*F01D 25/12* (2006.01)

(52) U.S. Cl.
CPC ..... *F01D 11/003* (2013.01); *F01D 9/023* (2013.01); *F01D 25/12* (2013.01); *F05D 2220/32* (2013.01); *F05D 2240/55* (2013.01)

(58) Field of Classification Search
CPC . F02C 7/28; F01D 9/023; F01D 11/00; F01D 11/003; F05D 2220/32; F16J 15/02; F16J 15/021; F16J 15/028; F16J 15/06; F16J 15/10
See application file for complete search history.

(56) References Cited

U.S. PATENT DOCUMENTS

| | | | | |
|---|---|---|---|---|
| 7,527,469 | B2 | 5/2009 | Zborovsky et al. | |
| 8,092,159 | B2 * | 1/2012 | Maldonado | F01D 5/186 29/889.721 |
| 8,206,093 | B2 * | 6/2012 | Irmisch | F01D 9/023 415/173.7 |
| 8,459,041 | B2 * | 6/2013 | Flanagan | F01D 11/005 60/796 |
| 2010/0239414 | A1 | 9/2010 | Tesh et al. | |

(Continued)

*Primary Examiner* — Steven M Sutherland
*Assistant Examiner* — Thuyhang N Nguyen
(74) *Attorney, Agent, or Firm* — Invenstone Patent, LLC

(57) ABSTRACT

A conjunction assembly provides a seal, in a connected state, between a conjunction ring constituting an outlet of a combustor and a turbine inlet cylinder constituting an inlet of the turbine. The conjunction assembly includes a connecting member that protrudes from the conjunction ring; a connecting groove for receiving the connecting member, the connecting groove formed in the turbine inlet cylinder; and a connection sealing member disposed between the connecting member and an inner surface of the turbine inlet cylinder to provide a seal between the connecting member and the inner surface of the turbine inlet cylinder. The connecting member is a ring-like structure formed on a rear-side surface of the conjunction ring, the rear-side surface facing the turbine inlet cylinder, and the connecting groove is formed in a front-side surface of the turbine inlet cylinder in correspondence to the connecting member, the front-side surface facing the conjunction ring.

8 Claims, 4 Drawing Sheets

(56) References Cited

U.S. PATENT DOCUMENTS

2013/0334772 A1* 12/2013 Halling ..... F01D 9/023
277/314
2015/0337677 A1* 11/2015 Roberge ..... F01D 15/10
290/52

* cited by examiner

CONJUNCTION ASSEMBLY AND GAS TURBINE COMPRISING THE SAME

CROSS-REFERENCE TO RELATED APPLICATIONS

This application claims priority to Korean Patent Application No. 10-2017-0127459, filed on Sep. 29, 2017, in the Korean intellectual Property Office, the disclosure of which is incorporated herein by reference in its entirety.

BACKGROUND OF THE INVENTION

Field of the Invention

Exemplary embodiments of the present disclosure relate to a conjunction assembly and a gas turbine comprising the same, and more particularly to a conjunction assembly for providing a seal, in a connected state, between a conjunction ring constituting an outlet of a combustor and a turbine inlet cylinder constituting an inlet of the turbine, and a gas turbine comprising the same.

Description of the Related Art

A turbine is a mechanism that obtains rotational force by impulsive force or reaction force generated using a flow of compressible fluid such as steam or gas. Examples of the turbine include a steam turbine using steam and a gas turbine using high temperature combustion gas. Gas turbines, among other types, are mainly composed of a compressor, a combustor, and a turbine.

The compressor is provided with an air inlet for introducing air, and a plurality of compressor vanes and compressor blades are alternately arranged in a compressor casing. The combustor supplies fuel to compressed air that is compressed in the compressor and ignites the air with a burner, which results in generation of combustion gas of high temperature and high pressure. The turbine has a plurality of turbine vanes and turbine blades, which are alternately arranged in a turbine casing. A plurality of disks are fixed to a rotor, and the blades are radially connected to each of the disks. The rotor is disposed so as to pass through the center of the compressor, the combustor and the turbine, and an exhaust chamber. Both ends of the rotor are rotatably supported by bearings, with the end of the rotor closer to the exhaust chamber being connected to a drive shaft of a generator, or the like.

The gas turbine has no reciprocating mechanism such as a piston of a four-stroke engine. Therefore, mutual friction parts like piston-cylinder do not exist, which leads to some advantages such as extremely low consumption of lubricating oil, drastic reduction in amplitude (which is characteristic of the reciprocating machine), and high speed motion.

In the operation of a gas turbine as above, air that has been compressed in the compressor is mixed with fuel and burned to produce high temperature combustion gas. The produced combustion gas is injected toward the turbine. The injected combustion gas passes through the turbine vanes and the turbine blades to generate a rotational force which, in turn, causes the rotor to rotate.

As a technique relating to a connection of the combustor of the gas turbine and the turbine, Korean Examined Utility Model Application Publication No. 20-0174662 (Apr. 1, 2000) discloses a gas turbine.

The gas turbine in the related art includes a conjunction assembly which is installed to surround and seal a space between the combustor and the turbine. Here, the conjunction assembly has disadvantages. For example, the conjunction assembly is pushed from the turbine to the combustor, and the position of the conjunction assembly changes due to vibration caused by a rotation drive of the turbine or by thermal deformation of a turbine inlet cylinder or the end of the combustor. In this case, a gap may be created at the contact portion of the conjunction assembly meeting the turbine inlet cylinder constituting the inlet of the turbine, as a result, gas may be leaked between the combustor and the turbine.

SUMMARY OF THE INVENTION

An object of the present disclosure is to provide a conjunction assembly and a gas turbine comprising the conjunction assembly capable of maintaining sealing of a conjunction between a turbine and a combustor in a stable connection state regardless of vibration or thermal deformation.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, there is provided a conjunction assembly that seals, in a connected state, a conjunction between a conjunction ring that constitutes an outlet of a combustor and a turbine inlet cylinder that constitutes an inlet of a turbine. The conjunction assembly may include a connecting member that protrudes from the conjunction ring; a connecting groove for receiving the connecting member, the connecting groove formed in the turbine inlet cylinder; and a connection sealing member disposed between the connecting member and an inner surface of the turbine inlet cylinder to provide a seal between the connecting member and the inner surface of the turbine inlet cylinder.

In accordance with another aspect of the present disclosure, a gas turbine may include a compressor that sucks and compresses air; a combustor that includes a liner in which fuel is burned with the compressed air to produce combustion gas, a transition piece through which the combustion gas passes, and a conjunction ring coupled to an end of the transition piece; a turbine that includes a turbine inlet cylinder that is disposed to be connected to an end of the conjunction ring and that passes the combustion gas to generate electricity; and the above conjunction assembly.

The connecting member may be a ring-like structure formed on a rear-side surface of the conjunction ring, the rear-side surface facing the turbine inlet cylinder, and the connecting groove may be formed in a front-side surface of the turbine inlet cylinder in correspondence to the connecting member, the front-side surface facing the conjunction ring.

The connection sealing member may include an outer seal inserted into the connecting groove to be in contact with an outer circumferential surface of the connecting member, and an inner seal inserted into the connecting groove to be in contact with an inner circumferential surface of the connecting member.

The conjunction assembly may further include an inserting groove formed in the inner surface of the turbine inlet cylinder, the inserting groove communicating with the connecting groove to receive the connection sealing member and allow an end of the connection sealing member to engage with the connecting member in an inserted state.

The conjunction assembly may further include an elastic support disposed in the connecting groove to elastically support the connection sealing member when the connection sealing member is inserted into the connecting groove. The elastic support may have one end in contact with the inner surface of the turbine inlet cylinder and the other end in contact with the connection sealing member. The elastic support may include a spring.

The conjunction assembly may further include a cooling channel formed in the turbine inlet cylinder for communicating with the connecting groove to allow compressed air to be guided into the connecting groove.

In the conjunction assembly and the gas turbine comprising the conjunction assembly according to aspects of the present disclosure, in order to connect the conjunction ring and the turbine inlet cylinder to each other, the connection sealing member is provided to seal any gap forming between the connecting member and the connecting groove in a state in which the connecting member protruding from the conjunction ring is inserted into the connecting groove of the turbine inlet cylinder. Accordingly, the conjunction ring is directly connected to the turbine inlet cylinder through the connecting member and the connecting groove, which makes it possible to maintain sealing of a conjunction between the turbine and the combustor in a stable connection state regardless of vibration or thermal deformation.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF EMBODIMENTS

Hereinafter, embodiments of a conjunction assembly and a gas turbine comprising the same according to embodiments of the present disclosure will be described with reference to the drawings.

Figure 1:
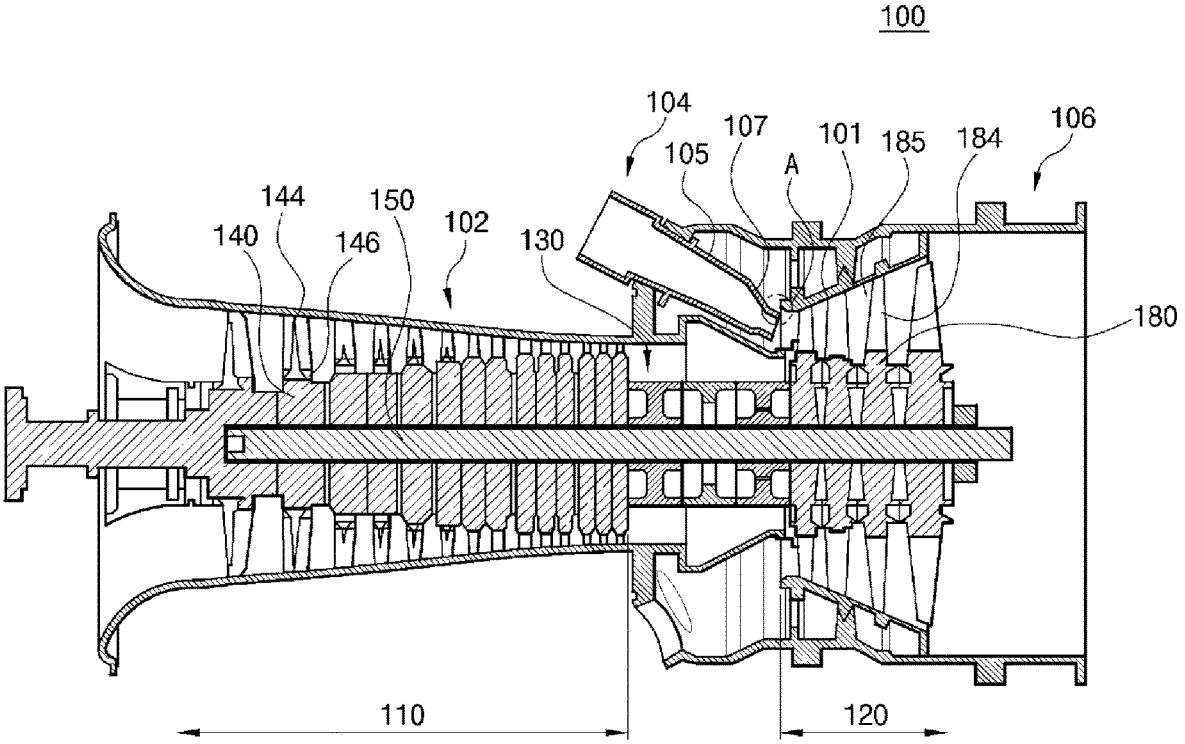
FIG. 1 is a sectional diagram showing a schematic structure of a gas turbine to which a conjunction assembly according to an embodiment of the present disclosure is applied.

Referring to FIG. 1, an example of a gas turbine 100 to which a conjunction assembly according to the present disclosure is applied is shown. The gas turbine includes a housing 102, and a diffuser 106 is provided on a rear side of the housing 102 to discharge a combustion gas passing through the turbine. A combustor 104 for burning compressed air that is supplied from the compressor to is disposed on the front side of the diffuser 106.

The description will be made with reference to a flow direction of air. A compressor section 110 constituting the compressor is positioned upstream within the housing 102, and a turbine section 120 constituting the turbine is positioned downstream within the housing 102. A torque tube 130 is positioned between the compressor section 110 and the turbine section 120 as a torque transmitting member for transmitting rotational torque generated in the turbine section to the compressor section.

The compressor section 110 is provided with a plurality of compressor rotor discs 140 and each of the compressor rotor discs 140 is fastened by a tie rod 150 so as not to be axially spaced apart.

Specifically, the compressor rotor discs 140 are each arranged in the axial direction with the tie rod 150 passing through the substantially center of each of the discs. Here, the compressor rotor discs 140 adjacent to each other are disposed such that the facing surfaces of the discs are pressed by the tie rod 150, and thus are not possible to rotate relative to each other.

A plurality of compressor blades 144 are radially coupled to the outer circumferential surface of the compressor rotor disc 140. Each of the compressor blades 144 has a root portion 146 and is fastened to the compressor rotor discs 140.

Vanes (not shown) fixed to the housing 102 are positioned between the compressor rotor discs 140. The vane is fixed so as not to rotate, like the compressor rotor discs 140, and serves to redirect the flow of compressed air that passes through the compressor blades 144 of the compressor rotor disc 140 and guide the air to the compressor blades 144 of the compressor rotor discs positioned downstream.

The root portion 146 is fastened by a tangential type method or an axial type method. The method may be selected according to the structure required for the commercial gas turbine and may be a dovetail type or a fir-tree type, which are commonly known. In some cases, the compressor blade may be fastened to the compressor rotor disc using fasteners of a type other than types described above, such as a key or a bolt.

The tie rod 150 is disposed to pass through the centers of the plurality of compressor rotor discs 140. One end of the tie rod 150 is fastened in the compressor rotor disc 140 positioned at the most upstream side of the flow, and the other end of the tie rod 150 is fixed in the torque tube 130.

The shape of the tie rod 150 may have various structures depending on the gas turbine, and the shape is not limited to the shape shown in FIG. 1. That is, one tie rod may have a shape passing through center of the rotor disc as shown in FIG. 1, a plurality of tie rods may have a shape arranged in a circumferential direction, or a combination of these may be used.

Although not shown, the compressor of the gas turbine may be provided with a vane serving as a guide pin at the next position of the diffuser to adjust a flow angle of a fluid entering an inlet of the combustor to a designed flow angle after increasing the pressure of the fluid, where the vane is called a deswirler.

In the combustor 104, the introduced compressed air mixed with fuel and the fuel mixed with the air is burned to produce high-temperature and high-pressure combustion gas with high energy, and in a constant-pressure combustion process the combustion gas temperature is raised up to the heat resistance limit that the combustor and turbine parts can withstand.

A plurality of combustors 104 constituting a combustion system of the gas turbine may be arranged in a casing formed in a cell shape. The combustor 104 includes a burner (not shown) including a fuel nozzle or the like, a combustor liner 105 forming a combustion chamber, and a transition piece 107 serving as a connection portion between the combustor and the turbine.

Specifically, the combustor liner 105 provides a combustion space in which the fuel injected by the fuel nozzle is mixed with the compressed air of the compressor and the fuel mixed with the air is burned. The combustor liner 105 may include a flame barrel that provides a combustion space in which the fuel mixed with air is burned, and a flow sleeve that forms an annular space while surrounding the flame barrel. The fuel nozzle is coupled to the front end of the combustor liner 105, and an ignition plug is coupled to a side wall of the combustor liner 105.

On the other hand, a transition piece 107 is connected to the rear end of the combustor liner 105 so that the combustion gas burned by the ignition plug can be transmitted to the turbine. The outer wall portion of the transition piece 107 is cooled by the compressed air supplied from the compressor so as to prevent breakage due to high temperature of the combustion gas.

To this end, the transition piece 107 is provided with holes (not shown) for cooling so as to inject air inside. The compressed air passing through the holes cools the inner main body and then flows to the combustor liner 105.

The cooling air that cools the transition piece 107 described above flows into the annular space of the combustor liner 105, and the compressed air supplied from the outside of the flow sleeve through cooling holes provided in the flow sleeve, as cooling air, may collide with the outer wall of the combustor liner 105.

Figure 2:
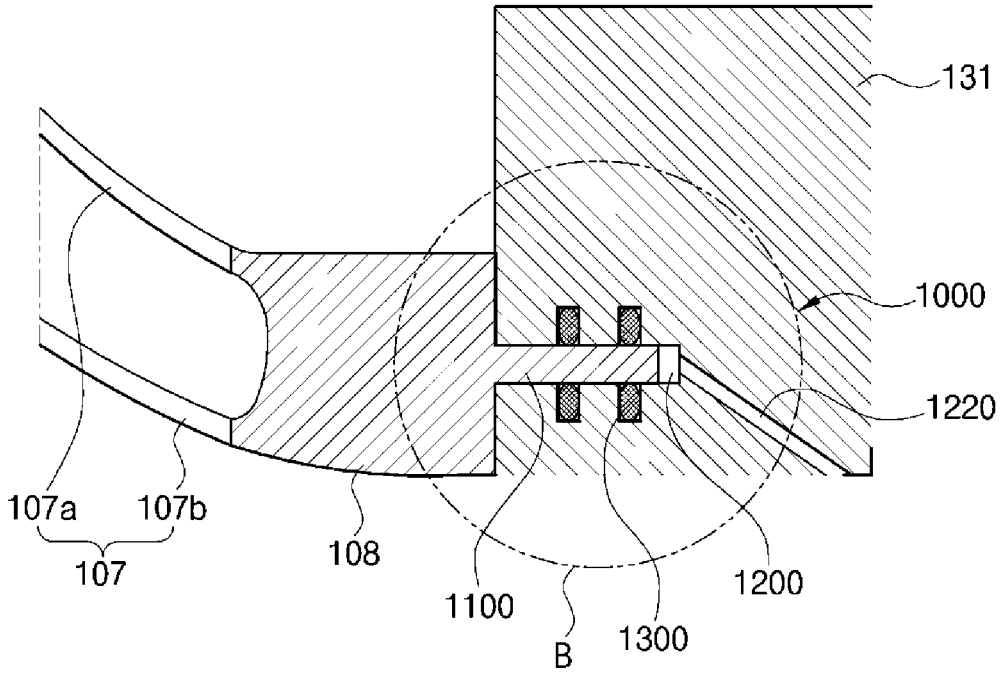
FIG. 2 is an enlarged view of a portion A in FIG. 1, illustrating a conjunction assembly according to the embodiment of the present disclosure.

Referring now to FIG. 2, the transition piece 107 includes an outer transition piece 107*a* forming an outer wall and an inner transition piece 107*b* forming an inner wall. A conjunction ring 108 is coupled to a rear end of the transition piece 107, where the conjunction ring 108 is coupled to the end of the outer transition piece 107*a* and the inner transition piece 107*b*, which are opposed to a turbine inlet cylinder 131 (described later). Accordingly, the conjunction ring 108 is formed such that the outer transition piece 107*a* and the inner transition piece 107*b* are fixed to each other, and prevents the compressed air flowing between the outer transition piece 107*a* and the inner transition piece 107*b* from flowing into a turbine.

Meanwhile, the high-temperature and high-pressure combustion gas from the combustor 104 is supplied to the turbine section 120 constituting the turbine described above. The supplied high-temperature and high-pressure combustion gas expands and collides with rotating blades of the turbine to produce the reaction force, which in turn generates rotational torque. The rotational torque obtained described above is transmitted to the compressor section 110 through a torque tube, and power exceeding the power required for driving the compressor is used to drive the generator and the like.

The turbine section 120 is basically similar in structure to the compressor section 110. That is, the turbine section 120 also includes a plurality of turbine rotor discs 180 similar to the compressor rotor discs 140 of the compressor section 110. Therefore, each of the turbine rotor discs 180 also includes a plurality of turbine blades 184 that are radially disposed. The turbine blades 184 may also be coupled to each of the turbine rotor discs 180, for example, in a dovetail type method. Furthermore, vanes 185 fixed to a housing 101 of the turbine section 120 are also provided between the turbine blades 184 of the turbine rotor discs 180 so that the vanes 185 guide the flow direction of the combustion gas passing through the turbine blades 184. Here, the turbine inlet cylinder 131 connected to the conjunction ring 108 may be formed at the front end of the housing 101 of the turbine section 120. A connecting groove 1200 (described later) is formed at the turbine inlet cylinder 131 to receive an insertion of a connecting member 1100 (described later).

Figure 3:
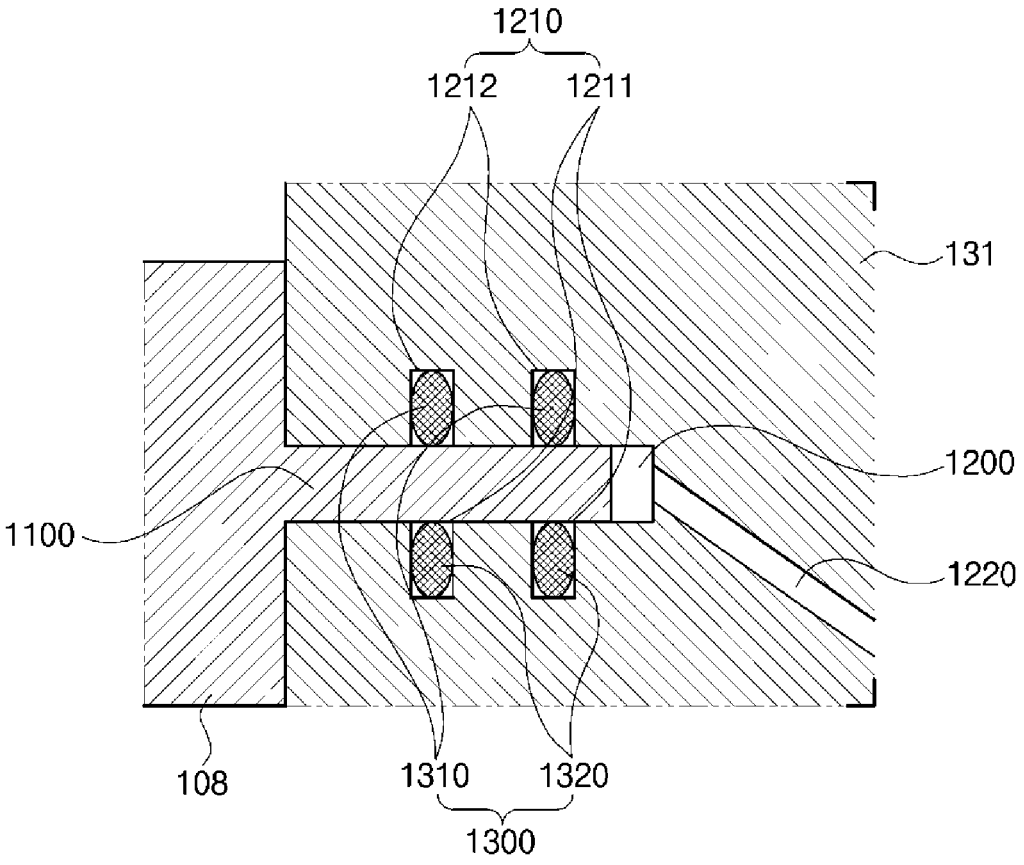
FIG. 3 is an enlarged view of a portion B in FIG. 2, illustrating a connection sealing member of the conjunction assembly according to the embodiment of the present disclosure.

Referring to FIGS. 2 and 3, a conjunction assembly 1000 according to the embodiment of the present disclosure is provided to connect the conjunction ring 108 and the turbine inlet cylinder 131 to each other. The conjunction assembly 1000 includes the connecting member 1100, the connecting groove 1200, and a connecting sealing member 1300 for providing a stable seal between the conjunction ring 108 and the turbine inlet cylinder 131 in a connected state.

The connecting member 1100 is formed at the conjunction ring 108, and enables sealing between the conjunction ring 108 and the turbine inlet cylinder 131 in a connected state. That is, even if the vibration generated by the rotational drive of the turbine section 120 or the thermal deformation of the turbine inlet cylinder 131 or the transition piece 107 occurs, the connecting member 1100 allows the conjunction ring 108 to be connected to the turbine inlet cylinder 131, thereby preventing the creation of a gap between the conjunction ring 108 and the turbine inlet cylinder 131, through which the compressed air supplied from the compressor may pass. As described above, when the vibration generated by the rotational drive of the turbine section 120 or the thermal deformation of the turbine inlet cylinder 131 or the transition piece 107 occurs, the connecting member 1100 allows the connection between the conjunction ring 108 and the turbine inlet cylinder 131 to be kept constant by moving the conjunction ring 108 and the turbine inlet cylinder 131 at the same time.

The connecting member 1100 has a ring-like structure that protrudes from one side of the conjunction ring 108 toward the turbine inlet cylinder 131. That is, the connecting member 1100 is formed on the rear-side surface of the conjunction ring 108 disposed to face the front side of the turbine inlet cylinder 131, and is inserted into the connecting groove 1200 correspondingly formed in the turbine inlet cylinder 131.

The connecting groove 1200 is a deep recess formed in a front-side surface of the turbine inlet cylinder 131 in correspondence to the connecting member 1100 to allow its insertion into the connecting groove 1200. That is, the connecting groove 1200 is formed in the front side of the turbine inlet cylinder 131 disposed to face the rear-side surface of the conjunction ring 108. Here, it is preferable that the cross-sectional diameter of the connecting groove 1200 has a size corresponding to the cross-sectional diameter of the connecting member 1100, and the depth of the connecting groove 1200 extending into the turbine inlet cylinder 131 may equal the length of the connecting member 1100. However, the length of the connecting groove 1200 is not limited to this configuration. The cross-sectional diameter of the connecting groove 1200 may be greater than the cross-sectional diameter of the connecting member 1100 and/or the depth of the connecting groove 1200 may be greater than the length of the connecting member 1100.

An inserting groove 1210 communicating with the connecting groove 1200 may be formed on an inner surface of the turbine inlet cylinder 131, an inserting groove 1210 for communicating with the connecting groove 1200 may be formed. The inserting groove 1210 allows one side of the connection sealing member 1300 to be engaged in an inserted state, to be described later, where the connecting member 1100 is inserted into the corresponding connecting groove 1200. In doing so, the inserting groove 1210 allows the connection sealing member 1300, in a fixed state, to seal any gap forming between the connecting member 1100 and the inner surface of the turbine inlet cylinder 131 where the connecting groove 1200 is formed. In addition, when the inserting groove 1210 further includes an elastic support (described later) for elastically supporting the connection sealing member 1300, the inserting groove 1210 provides a space into which the elastic support can be inserted in a fixed state. Here, the inserting groove 1210 includes an outer inserting groove 1212 and an inner inserting groove 1211. In this case, the outer inserting groove 1212 communicates with the connecting groove 1200 on the outer circumferential surface of the turbine inlet cylinder 131 with respect to the connecting groove 1200, enabling one side of an outer seal 1310 of the connecting sealing member 1300 to be engaged in the inserted state. The inner inserting groove 1211 communicates with the connecting groove 1200 on the inner circumferential surface of the turbine inlet cylinder 131 with respect to the connecting groove 1200, enabling one side of an inner seal 1320 of the connecting sealing member 1300 to be engaged in the inserted state In addition, a cooling channel 1220 may be formed in the turbine inlet cylinder 131 so as to communicate with the connecting groove 1200. The cooling channel 1220 may cool the turbine inlet cylinder 131, the connecting member 1100, and the connection sealing member 1300 by allowing the compressed air supplied from the compressor to flow into the connecting groove 1200.

In a state in which the connecting member 1100 is inserted into the connecting groove 1200, the connection sealing member 1300 provides a seal between the connecting member 1100 and the inner surface of the turbine inlet cylinder 131 where the connecting groove 1200 is formed. That is, the connection sealing member 1300 increases the airtightness between the connecting member 1100 and the inner side of the connecting groove 1200, which makes it possible to prevent the compressed air or the combustion gas in the combustor 104 from leaking to the opposite sides through the connecting groove 1200. In addition, since the connection sealing member 1300 elastically supports the connecting member 1100 inserted into the connecting groove 1200, the connecting member 1100 absorbs the vibration caused by the rotational drive of the turbine section 120, and even if the connecting member 1100 and the turbine inlet cylinder 131 are thermally deformed, the connection sealing member 1300 prevents the connecting member 1100 from being pushed out of the connecting groove 1200, thereby maintaining a stable sealing. Here, it is preferable that the connection sealing member 1300 is formed of a rubber material or a synthetic resin material having flexibility and elasticity, but is not limited thereto.

The connection sealing member 1300 includes the outer seal 1310 and the inner seal 1320. The outer seal 1310 is inserted into the outer inserting groove 1212 of the inserting groove 1210 of the connecting groove 1200 so as to be in contact with the outer circumferential surface of the connecting member 1100, and provides a seal between the outer circumferential surface of the connecting member 1100 and the inner side of the connecting groove 1200. The inner seal 1320 is inserted into the inner inserting groove 1211 of the inserting groove 1210 of the connecting groove 1200 so as to be in contact with the inner circumferential surface of the connecting member 1100, and provides a seal between the inner circumferential surface of the connecting member 1100 and the inner side of the connecting groove 1200.

Figure 4:
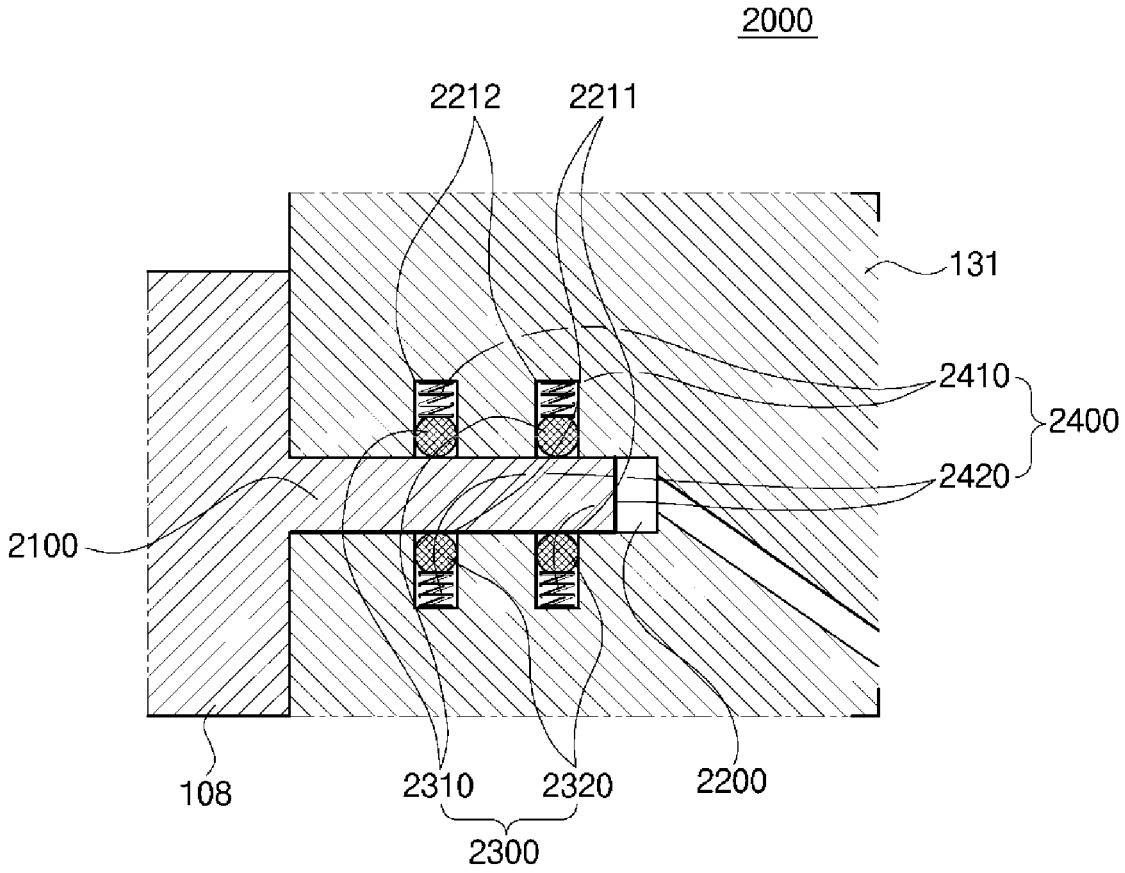
FIG. 4 is an enlarged view of a portion B in FIG. 2, illustrating a connection sealing member of a conjunction assembly according to another embodiment of the present disclosure.

FIG. 4 illustrates a conjunction assembly 2000 according to another embodiment of the present disclosure. The conjunction assembly 2000 may be included in a gas turbine according to another embodiment of the present disclosure.

Referring to FIG. 4, the conjunction assembly 2000 may further include an elastic support 2400.

The elastic support 2400 is a member having an elastic force and is inserted into a connecting groove 2200 so as to elastically support a connection sealing member 2300. The elastic support 2400 applies a force to push the connection sealing member 2300 toward a connecting member 2100 such that the connection sealing member 2300 maintains a stable close contact state with the connecting member 2100, and the connecting member 2100 stably seals any gap between the connecting member 2100 and the inner side of the connecting groove 2200 in a state in which the connecting member 2100 is inserted into the connecting groove 2200. In this case, one end of the elastic support 2400 extends to be in contact with the inner surface of the turbine inlet cylinder 131 and the other end of the elastic support 2400 extends to be in contact with the connection sealing member 2300. More specifically, the elastic support 2400 includes an outer elastic support 2410 and an inner elastic support 2420.

The outer elastic support 2410 elastically supports an outer seal 2310 of the connection sealing member 2300 to push the outer seal 2310 toward the outer circumferential surface of the connecting member 2100 in a state in which the outer elastic support 2410 is inserted into an outer inserting groove 2212 of the connecting groove 2200. The inner elastic support 2420 elastically supports an inner seal 2320 of the connection sealing member 2300 to push the inner seal 2320 toward the inner circumferential surface of the connecting member 2200 in a state in which the inner elastic support 2420 is inserted into an inner inserting groove 2211 of the connecting groove 2200.

As described above, in the conjunction assembly and the gas turbine comprising the conjunction assembly according to the present disclosure, in order to connect the connecting ring and the turbine inlet cylinder to each other, the connection sealing member is provided to seal any gap forming between the connecting member and the connecting groove in a state in which the connecting member protruding from the connecting ring is inserted into the connecting groove of the turbine inlet cylinder. Accordingly, the connecting ring is directly connected to the turbine inlet cylinder through the connecting member and the connecting groove, which makes it possible to maintain sealing of the conjunction between the turbine and the combustor in a stable state regardless of vibration or thermal deformation.

While the present disclosure has been described with reference to embodiments shown in the drawings, these are merely illustrative, and it is to be understood by those skilled in the art that various modifications and equivalent embodiments can be made. Therefore, the true scope of protection of the present disclosure should be determined by the technical spirit of the appended claims.

What is claimed is:

1. A conjunction assembly that seals, in a connected state, a conjunction between a conjunction ring that constitutes an outlet of a combustor and a turbine inlet cylinder that constitutes an inlet of a turbine, the conjunction assembly comprising:

a connecting member that protrudes from the conjunction ring;

a connecting groove for receiving the connecting member, the connecting groove formed in the turbine inlet cylinder; and a connection sealing member disposed between the connecting member and an inner surface of the turbine inlet cylinder to provide a seal between the connecting member and the inner surface of the turbine inlet cylinder, the connection sealing member including:

an outer seal inserted into the connecting groove to be in contact with an outer circumferential surface of the connecting member, and an inner seal inserted into the connecting groove to be in contact with an inner circumferential surface of the connecting member; an inserting groove formed in the inner surface of the turbine inlet cylinder, the inserting groove communicating with the connecting groove and being configured to receive the connection sealing member and to allow an end of the connection sealing member to engage with the connecting member in an inserted state, the inserting groove including an outer inserting groove configured to receive the outer seal and an inner inserting groove configured to receive the inner inserting groove;

an outer spring disposed on an outer side of the inserting groove and configured to elastically support the outer seal and to push the outer seal toward the outer circumferential surface of the connecting member when the connection sealing member is inserted into the connecting groove; and an inner spring disposed on an inner side of the inserting groove and configured to elastically support the inner seal and to push the inner seal toward the inner circumferential surface of the connecting member when the connection sealing member is inserted into the connecting groove.

2. The conjunction assembly of claim 1, wherein the connecting member is a ring-like structure formed on a rear-side surface of the conjunction ring, the rear-side surface facing the turbine inlet cylinder, and wherein the connecting groove is formed in a front-side surface of the turbine inlet cylinder in correspondence to the connecting member, the front-side surface facing the conjunction ring.

3. The conjunction assembly of claim 1, wherein each of the outer spring and the inner spring has one end in contact with the inner surface of the turbine inlet cylinder and the other end in contact with the connection sealing member.

4. The conjunction assembly of claim 1, further comprising:

a cooling channel formed in the turbine inlet cylinder for communicating with the connecting groove to allow compressed air to be guided into the connecting groove.

5. A gas turbine comprising:

a compressor that sucks and compresses air;

a combustor that includes a liner in which fuel is burned with the compressed air to produce combustion gas, a transition piece through which the combustion gas passes, and a conjunction ring coupled to an end of the transition piece;

a turbine that includes a turbine inlet cylinder that is disposed to be connected to an end of the conjunction ring and that passes the combustion gas to generate electricity; and a conjunction assembly that includes a connecting member that protrudes from the conjunction ring;

a connecting groove for receiving the connecting, member, the connecting groove formed in the turbine inlet cylinder; and a connection sealing member disposed between the connecting member and an inner surface of the turbine inlet cylinder to provide a seal between the connecting member and the inner surface of the turbine inlet cylinder, the connection sealing member including:

an outer seal inserted into the connecting groove to be in contact with an outer circumferential surface of the connecting member, and an inner seal inserted into the connecting groove to be in contact with an inner circumferential surface of the connecting member;

an inserting groove formed in the inner surface of the turbine inlet cylinder, the inserting groove communicating with the connecting groove and being configured to receive the connection sealing member and to allow an end of the connection sealing member to engage with the connecting member in an inserted state, the inserting groove including an outer inserting groove configured to receive the outer seal and an inner inserting groove configured to receive the inner inserting groove;

an outer spring disposed on an outer side of the inserting groove and configured to elastically support the outer seal and to push the outer seal toward the outer circumferential surface of the connecting member when the connection sealing member is inserted into the connecting groove; and an inner spring disposed on an inner side of the inserting groove and configured to elastically support the inner seal and to push the inner seal toward the inner circumferential surf ace of the connecting member when the connection sealing member is inserted into the connecting groove.

6. The gas turbine of claim 5, wherein the connecting member is a ring-like structure formed on a rear-side surface of the conjunction ring, the rear-side surface facing the turbine inlet cylinder, and wherein the connecting groove is formed in a front-side surface of the turbine inlet cylinder in correspondence to the connecting member, the front-side surface facing the conjunction ring.

7. The gas turbine of claim 5, wherein each of the outer spring and the inner spring has one end in contact with the inner surface of the turbine inlet cylinder and the other end in contact with the connection sealing member.

8. The gas turbine of claim 5, further comprising:

a cooling channel formed in the turbine inlet cylinder for communicating with the connecting groove to allow compressed air to be guided into the connecting groove.

* * * * *